United States Patent [19]

Klingenberg

[11] Patent Number: 4,459,039

[45] Date of Patent: Jul. 10, 1984

[54] PRESSURE COMPENSATED WATCH ENCLOSURE

[76] Inventor: Hans U. Klingenberg, 3274 St. Niklaus bei Merzligen, Canton of Berne, Switzerland

[21] Appl. No.: 512,571

[22] PCT Filed: Jun. 19, 1980

[86] PCT No.: PCT/CH80/00072

§ 371 Date: Mar. 16, 1981

§ 102(e) Date: Mar. 3, 1981

[87] PCT Pub. No.: WO81/00311

PCT Pub. Date: Feb. 5, 1981

Related U.S. Application Data

[63] Continuation of Ser. No. 247,532, Mar. 3, 1981, abandoned.

[30] Foreign Application Priority Data

Jul. 16, 1979 [CH] Switzerland ..... 6614/79

[51] Int. Cl.[3] ..... G04B 37/00

[52] U.S. Cl. ..... 368/289; 368/291

[58] Field of Search ..... 368/269, 290, 291, 292

[56] References Cited

U.S. PATENT DOCUMENTS

| | | | |
|---|---|---|---|
| 2,656,674 | 10/1953 | Bondy . | |
| 3,030,763 | 4/1962 | Klingenberg | 368/291 |
| 3,860,844 | 1/1975 | Hetzel . | |
| 4,080,781 | 3/1978 | Klingenberg . | |

FOREIGN PATENT DOCUMENTS

| | | |
|---|---|---|
| 429618 | 1/1926 | Fed. Rep. of Germany . |
| 2045830 | 3/1971 | France . |
| 7166/73 | 6/1975 | Switzerland . |

*Primary Examiner*—Bernard Roskoski

*Attorney, Agent, or Firm*—Parkhurst & Oliff

[57] ABSTRACT

At the time of the casing of a watch in the back of which a diaphragm (19) is placed, an insulating and inert transparent liquid is caused to penetrate into the interior of the case by placing the whole in an enclosure under negative pressure. The air is exhausted, and the liquid in question comes to occupy the space included between the module (1) and the walls of the case. A small quantity of air contained under the diaphragm (19) expands under the effect of the negative pressure and causes this diaphragm to swell, which gives a compensating volume allowing thereafter the thermal expansion of the liquid within the case and without subjecting the walls of the latter to stresses.

4 Claims, 3 Drawing Figures

PRESSURE COMPENSATED WATCH ENCLOSURE

This is a continuation of application Ser. No. 247,532 filed Mar. 3, 1981, now abandoned.

Patents CH 608 325 and 609 828 describe electronic wrist watches, the module of which is protected against external influences by a liquid which occupies the inner space of the case. The presence of a liquid in the environment of the electronic module of a wrist watch is known to constitute a protection against shocks, on the one hand, and against oxidation, on the other hand. Another factor which plays a particularly important part and which tends to preserve the operating qualities of an electronic watch when the time-standard of this watch is a quartz is the fact that the liquid also constitutes a protection against the gradual penetration of air into the interior of the capsule of the quartz.

The production of an electronic wrist watch, the module of which bathes in a liquid, poses the problem of the expansion of this liquid in case of increase of the temperature, or more exactly, at the time of a differential variation of the volume of the liquid relative to the volume of the case under the effect of a temperature variation.

The object of the present invention is to provide a new solution better adapted than the known solutions to the requirements of practice, taking into account the specific conditions resulting from the thermal expansion of the liquid.

To this end, the present invention has as its subject an electronic wrist watch comprising a case in at least two parts fixed to one another in a fluid-tight and detachable manner, and an electronic module housed in the case and bathing in a liquid, characterized in that at least one of the said parts of the case is deformable under stress and in that the said liquid is, at the ambient temperature, at a lower pressure than the atmospheric pressure, thus maintaining the said case part in a deformed position.

For casing up, a process may be applied which also forms part of the invention and which is characterized in that the case equipped with the module is placed in a liquid at ambient temperature and at atmospheric pressure, the two parts of the case resting one upon the other by means of annular seats which they both present, the air is exhausted from the case and the latter is filled with liquid, then the whole is subjected to a temperature rise of predetermined value while forces which press them on their seats are exerted on the said parts of the case, after which the whole is returned to the ambient temperature while the said external forces are maintained.

Figure 1:
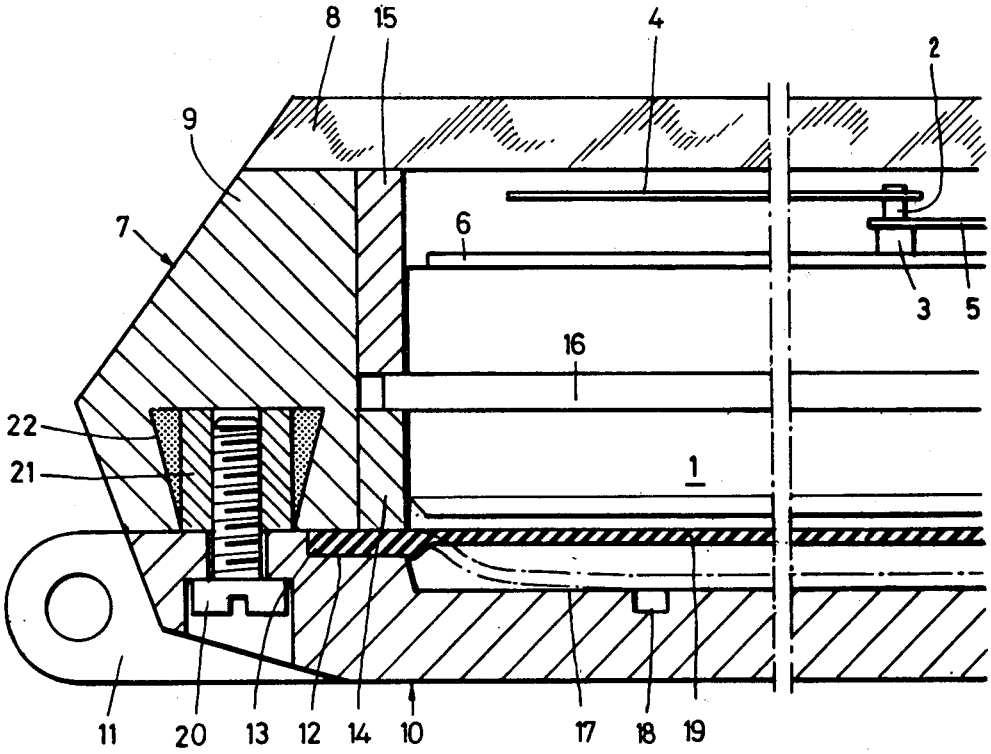
Figure 2:
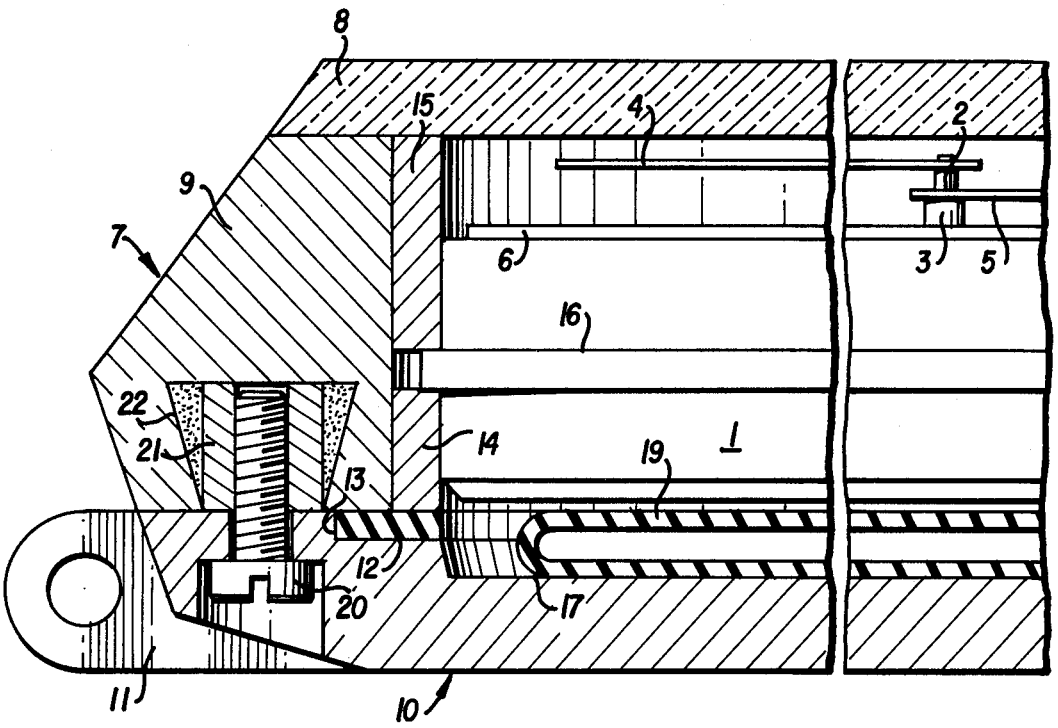
Figure 3:
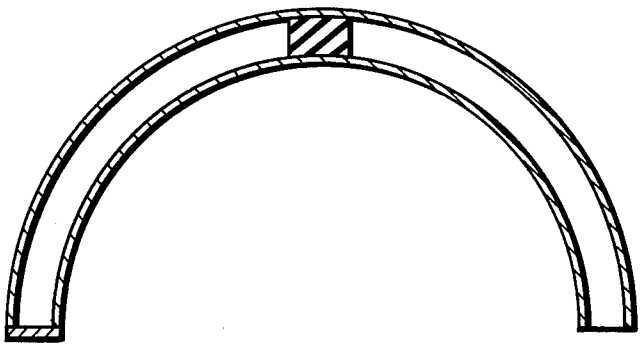

Several embodiments of the watch according to the invention will be described below, by way of example, referring to the figures of the appended drawings, FIG. 1 is a partial axial sectional view of a first embodiment of the invention;

FIG. 2 is a partial axial sectional view of a second embodiment of the invention; and FIG. 3 is a top sectional view of a portion of a third embodiment of the invention.

The watch depicted in the drawing comprises an electronic module 1. It is a module of the type having a display with hands which is concerned. It therefore comprises, for example, a stepping motor (not depicted) which drives a wheel-train actuating the moving parts 2 and 3 respectively bearing a minute-hand 4 and an hour-hand 5. These hands move above a dial 6 which is fixed on the module 1. The latter contains a battery (not depicted) which plays the part of a current source. Possibly, a panel may be provided for collecting solar energy. The constitution of this module is of a completely usual type. As a variant, the module 1 might also be replaced by a module of the digital-display type with liquid crystal, with luminescent diodes, with electrochromic elements, or operating according to any other system.

The case depicted in the drawing comprises a first part designated by 7, which is formed by a glass 8 and a caseband 9, and a second part 10 which forms the back of the case. The caseband 9 is cemented along the periphery of the lower face of the glass 8. It is a matter of an arrangement which permits this caseband to be made of a material such as synthetic stone, a ceramic, etc.

The back 10 includes a flat piece, preferably metallic 11 with, in its inner face, an annular detachment 12 which serves to accommodate a gasket 13 supporting a movement-holder frame 14. A maintaining ring 15, disposed between the glass 8 and the fillet 16 of the module 1, holds the latter in place.

Of course, the shape of the watch described is not limited to a circular shape. The watch may as well be of rectangular, square, oval, rounded-side, etc. shape.

The central part of the piece 11 presents, in its inner face, a recess 17, the bottom of which is flat. Moreover, in the vicinity of the periphery of this recess, a groove 18 may be contrived. At the time of the fabrication of the back, there is placed in the recess 17 a thin diaphragm 19 of plastic material which is cut out in such a way as to lie exactly flat on the bottom of the recess 17. This diaphragm is cemented along its periphery on the inner face of the back. In the embodiment depicted, the gasket 13 is made in one piece with the diaphragm 19, of which it forms the outer rim.

Thus, the watch case described comprises a composite portion which constitutes the back and is composed of the rigid part 10 and of the diaphragm 19 joined to the part 10 by its periphery. This diaphragm may be of an elastically deformable material or of a flexible material. Thus, in the case where it is lying flat against the incurvated inner face of the part 10, a diaphragm 19 of flexible material can move away from the inner face of the back at the time the liquid is put under negative pressure, the mass of air occluded between the part 10 and the diaphragm then expanding as a function of the reduction of pressure which is imposed upon the liquid.

It will now be described how casing takes place:

The module 1, equipped with the dial and the hands, is mounted inside the part 7 of the case, after which the back 10, equipped with the diaphragm 19 which is laid flat in the recess 17, is placed on the periphery of the caseband 9 with interposition of the gasket 13. The corresponding seats of the two parts rest one upon the other. The whole is placed in an enclosure which contains a transparent and inert insulating liquid, e.g., glycerin, a silicone, etc. The choice of this liquid will be determined by the properties which it must present, and which result from the functions it must fulfill, as will be seen below. Before the back is tightened, the enclosure which contains the liquid and the watch is closed, and the interior of this enclosure is put under negative pressure, by means of a vacuum pump, for example. It is easily realized that as the pressure falls, the air contained in the inner space of the case escapes little by little while raising the back 10 slightly, so that the liquid penetrates into the case. The pressure is reduced thus to a suitable value, which may reach, for example, 20 millibars, or about 15 mm Hg. Now, at this negative pressure, the air which remains contained between the diaphragm 19 and the piece 11, and the mass of which is proportioned by the volume of the groove 18, expands, so that the diaphragm 19 rises and occupies part of the volume left free between the back 10 and the module 1.

By way of example, if the surface covered by the diaphragm 19 attains, for example, 200 $mm^2$ and if the total volume of the space between diaphragm and back is on the order of 1 $mm^3$, an average rising of the diaphragm 19 attaining 25/100 mm is going to correspond to a freed volume on the order of 50 $mm^3$. Thus, the expansion of the air contained originally in the groove 18 may attain 50 times its initial volume, which corresponds to a reduction in pressure of 98% and, consequently, to an absolute pressure of 20 millibars. The watch is then practically under vacuum.

The air having been entirely exhausted from the inner space of the case by putting the enclosure under vacuum, it then suffices to re-establish the pressure in the vacuum chamber, preferably by pressing on a valve which is generally provided for in the bottom or the glass. The liquid outside the case ensures the compression of the back against the caseband 9. The screws 20 can then be locked.

A usual round back will be locked by manipulation from the outside in the chamber which is under vacuum, within the liquid. It will also be noted that the part ensuring the closure will not always be the back. The glass may also play this part, as in the so-called "Vacuum" watches already known. An exhaust-valve, of the non-return valve type, may also be provided for.

It is realized that in case of temperature variations, the variations in volume of the liquid which fills the inner space of the case are going to cause variations of the volume enclosed by the diaphragm 19. The negative pressure therefore varies slightly. A watch is obtained, the inner space of which is maintained at negative pressure but is occupied by a liquid. These conditions ensure the maximum of reliability for an electronic watch, especially for a quartz watch.

If need be, the groove 18 might be eliminated, the quantity of air which remains enclosed between the back and the diaphragm 19 at the time the latter is put in place being sufficient to ensure the expansion of the deformable enclosure.

One may also go about it otherwise for effectuating the casing, avoiding the use of a device allowing a high vacuum to be caused within an enclosure containing the liquid. After the two parts of the case have been placed inside a recipient containing the liquid, and the air has been completely exhausted from the inside of the case, the whole of the liquid contained in the recipient may be heated, up to a temperature on the order of 60° to 80° C., for example. The mass of liquid contained within the case is therefore going to undergo a thermal expansion, and part of this mass is going to leave the case. During this operation, care will be taken to exert between the two parts of the case a regulated force tending to keep the case closed, while permitting the evacuation of the surplus liquid under the effect of the expansion. For that purpose, the two parts of the case may be placed one upon the other, and provision may be made for causing a weight or a spring to act upon the part situated above. Once the entirety of the liquid in which the case and the module are bathing has been brought to the required temperature, it will suffice to allow cooling. The presence of the weight or of the spring which compresses the two parts of the case one against the other will prevent the liquid from re-entering the case, so that upon cooling, the negative pressure required will be set up spontaneously. The exhaustion of the air out of the case may also be ensured before the heating of the enclosure, without using a vacuum pump. It suffices, indeed, to cause any fuel to burn within the closed enclosure containing the liquid in order to bind the oxygen from the air, according to the principle described in the patent CH 533 832.

Other embodiments are also possible. The deformable case part which is maintained in the deformed state under stress, instead of being constituted by the diaphragm 19 and the rigid piece 11, might also be constituted by a usual back and a small bag made of plastic material placed freely or fixed by any means between the back and the module, as shown in FIG. 2. In other designs, provision might be made, for example, for a deformable enclosure constituted by a rigid tube, e.g., a tube in the shape of a circle segment, one end of which would be closed, whereas the other end would be open, as shown in FIG. 3. A movable plug, e.g., a drop of mercury, would separate within this tube the zone constituting the deformable enclosure occupied by a small mass of gas and the outer portion communicating with the inner space of the case and consequently occupied by the liquid which fills the case. A metallic back or a part constituting the glass, slightly deformable under the effect of the pressure, might also constitute the case part deformable under stress, which maintains the negative pressure in the case.

In all these embodiments, the two casing processes described above are applicable.

If the battery is housed within the module 1, the change of battery necessitates the opening of the case, so that it is then necessary to re-establish the vacuum and, if need be, to replace the liquid lost at each change of battery. As has been seen above, however, this operation is extremely simple to effect.

However, it has been found that it was advantageous to keep the battery in contact with the protective liquid. Indeed, the losses due to the influence of the ambient atmosphere are then reduced. As a result, the watch described ensures a longer running time of the battery than what has been known until now. Now, batteries are already presently known which can ensure a running autonomy on the order of 6 to 7 years, so that, practically, any battery replacement can be dispensed with.

The properties which the liquid must present are principally the following: it must be transparent, insulating, chemically inert, of low volatility. Different liquids which meet these conditions are known, besides the silicones and glycerin, already mentioned.

On the other hand, if there is reason for allowing easy and frequent changes of batteries, it may likewise be provided for to place the battery in a housing separated from the inner space of the case, only this inner space being occupied by the liquid, whereas a separate cover gives access to the battery.

Finally, the realization described lends itself more particularly to designs in which the elements of the case are solid and rigid elements, i.e., elements of synthetic stone, of ceramics, or of sintered metallic or other compositions. Indeed, the great hardness of such materials is known to be accompanied by a very high resistance to deformation, so that the effect of the atmospheric pressure being exerted on the case does not entail practically any deformation.

I claim:

1. A watch comprising an electronic module having a display device, and a casing comprising a first enclosure formed of a plurality of rigid wall portions sealingly connected to one another and defining a main inner space of a substantially unvariable volume which is entirely sealed from the outer atmosphere, and a second enclosure at least partly comprised of a deformable wall portion, said second enclosure defining within the main inner space of said first enclosure two sub-spaces, the respective volumes of which are inversely variable through deformation of said deformable wall portion, a first one of said sub-spaces being filled with a liquid and containing said module and display device, the other one of said sub-spaces being filled with a gas, said liquid and said gas being at the same pressure, said pressure being a negative pressure.

2. A watch according to claim 1, wherein said first enclosure comprises a back part and a case-band part, said back part is removably secured to said case-band part, and said deformable wall portion is a flexible diaphragm located inside said back part and joined fluid-tightly to said back part by its periphery, the said outer sub-space being defined by said diaphragm and said back part.

3. A watch according to claim 1, wherein said first enclosure comprises a back part and a case-band part, said back part is removably secured to said case-band part, and said deformable wall portion is a bag made of a flexible material joined to the back part, disposed between the latter and the module.

4. A watch comprising an electronic module having a display device, and a casing comprising a first enclosure formed of a plurality of rigid wall portions sealingly connected to one another and defining a main inner space of a substantially unvariable volume which is entirely sealed from the outer atmosphere, and a second enclosure at least partly comprised of a deformable wall portion, said second enclosure defining within the main inner space of said first enclosure two sub-spaces, the respective volumes of which are inversely variable through deformation of said deformable wall portion, a first one of said sub-spaces being filled with a liquid and containing said module and display device, the other one of said sub-spaces being filled with a gas, said liquid and said gas being at the same pressure, said pressure being a negative pressure, said deformable wall portion comprising a tubular rigid element having a closed end and a plug located within said tubular element which is spaced apart from said closed end and movable within said tubular element, said other sub-space being defined by said tubular element, said plug and said closed end.

* * * * *